US005995586A

United States Patent [19]

Jahnke

[11] Patent Number: 5,995,586

[45] Date of Patent: Nov. 30, 1999

[54] X-RAY GENERATOR

[75] Inventor: Andreas Jahnke, Munich, Germany

[73] Assignee: Siemens Aktiengesellschaft, Munich, Germany

[21] Appl. No.: 09/041,814

[22] Filed: Mar. 12, 1998

[30] Foreign Application Priority Data

Mar. 12, 1997 [DE] Germany ..... 197 10 222

[51] Int. Cl.[6] ..... H01J 35/30

[52] U.S. Cl. ..... 378/137; 378/113; 378/10

[58] Field of Search ..... 378/137, 113, 378/10, 4

[56] References Cited

U.S. PATENT DOCUMENTS

| | | | |
|---|---|---|---|
| 4,352,021 | 9/1982 | Boyd et al. | 378/12 |
| 4,521,900 | 6/1985 | Rand | 378/137 |
| 4,625,150 | 11/1986 | Rand | 315/111.31 |
| 5,172,401 | 12/1992 | Asari et al. | 378/10 |

FOREIGN PATENT DOCUMENTS

OS 195 15 415 7/1996 Germany .

OTHER PUBLICATIONS

"High–Speed Computed Tomography: Systems and Performance," Peschmann et al., Applied Optics, vol. 24, No. 23, Dec. 1, 1985, pp. 4052–4060.

*Primary Examiner*—David P. Porta
*Assistant Examiner*—Michael J. Schwartz
*Attorney, Agent, or Firm*—Hill & Simpson

[57] ABSTRACT

An x-ray generator has a beam guidance system including an air coil and a toroidal solenoid coil, a ring anode surrounding the patient to be examined and arranged axially offset relative to the beam guidance, and individually driveable electron-optical components couple the electrons, which orbit on a circular specified path in the magnetic dipole field of the air coil, out of that path, deflect them in the axial direction, and focus them onto a segment of the ring anode allocated to the respectively activated out-coupling element.

12 Claims, 6 Drawing Sheets

CONDUCTOR
CONDUCTOR
B
B
9
5
8
$r_s$ 10
9
8
$r_s$
CONDUCTORS e'
I
I
540A
CONDUCTOR
5
9
r''
r'
8
9
CONDUC-
TOR
8
e'
11

X-RAY GENERATOR

BACKGROUND OF THE INVENTION

1. Field of the Invention

The present invention is directed to an x-ray generator of the type having an electron source which emits electrons which follow a specified path, means for deflecting the electrons from the specified path in the direction of an anode, and a beam guidance system, including a solenoid coil, which guides the deflected electrons onto the anode.

2. Description of the Prior Art

The electron beam-shaping part of a computed tomography apparatus basically composed of an electron source, an evacuated drift tube equipped with ion traps, and a lens system which generates time-dependent, magnetic dipole and quadrupole fields and which deflects the electrons from the horizontal beam axis and focuses them onto one a number of tungsten anodes which surround the patient in the fashion of a half-ring. (See, for example, U.S. Pat. Nos. 4,352,021 and 4,521,900 and 4,625,150 and "High-speed Computed Tomography: Systems and Performance," Peschmann et al., Applied Optics, Vol. 24, No. 25, December 1985, pp. 4052–4060) A detector that is likewise shaped like a half-ring measures the intensity of the x-rays emitted in the region of the electron focus, which has a size of approximately 2.5×5 $mm^2$. The x-rays are collimated into a fan-like beam by a diaphragm system and are partially absorbed in the patient according to the density of the respectively transirradiated tissue segment. The position of the x-ray source relative to the patient can be modified very quickly by deflecting the electron beam on the anode rings. The useable angular range, however, amounts to a maximum of 210° due to physical limitations imposed by the structure.

Conventional tomography systems are equipped with rotating anode x-ray tubes (40 kW, 140 kV) operated pulsed, and with ring detectors, with mechanical drives moving both the x-ray tubes and the detector elements in a circle around the patient. The stability and loadability of the mechanical components, which are thus subjected to strong centrifugal forces limits the rotational frequency of the x-ray tubes to a maximum of 1 rotation/sec.

An x-ray generator known from German OS 195 15 415 is composed of an electron source, of a beam guidance deflecting the electrons onto a circular rated path, of a ring anode arranged axially offset relative to the beam guidance, and of electron-optical components that couple the electrons circulating within a solenoid coil out and deflect them in a direction of the ring anode.

SUMMARY OF THE INVENTION

An object of the present invention is to provide a comparatively simple and compactly constructed x-ray generator whose source can be very rapidly conducted around the subject to be transirradiated, particularly several times per second on a circular path.

The above object is achieved in accordance with the principles of the present invention in an x-ray generator of the type initially described, wherein the anode is disposed inside of the solenoid coil of the beam guidance system.

The employment of the inventive x-ray generator in a computed tomography apparatus allows a number of scans of the type referred to as 360° x-ray scans to be implemented within a time interval amounting to only fractions of a second. Such an apparatus is therefore particularly suitable for time-resolved examinations of the cardiac cycle.

DESCRIPTION OF THE PREFERRED EMBODIMENTS a) The Beam Guidance System

Figure 1:
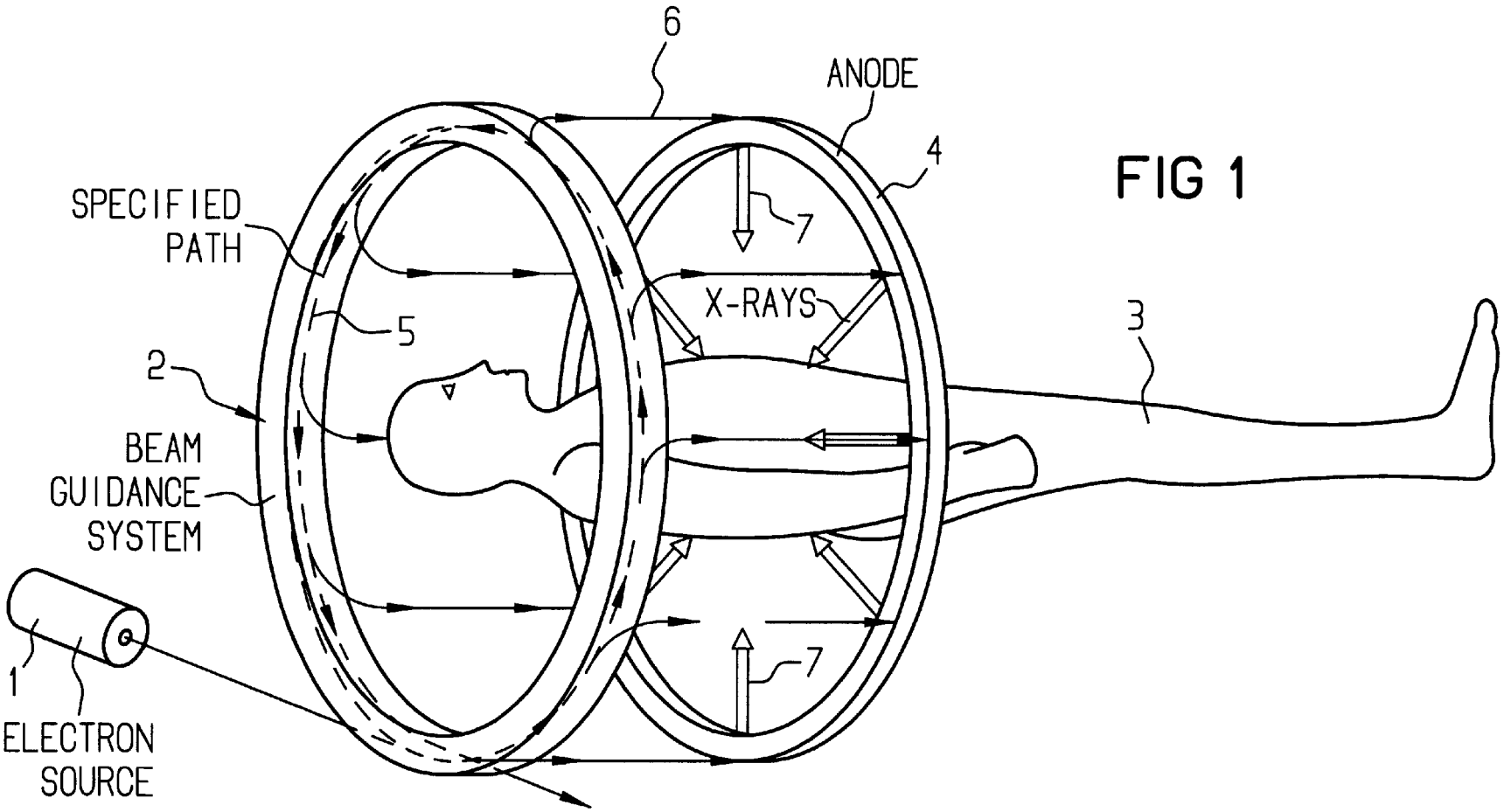
FIG. 1 is a schematic illustration showing the basic structure of the inventive x-ray generator, in a perspective view.

The x-ray generator (shown simplified in FIG. 1) of a computed tomography apparatus is basically composed of an electron source 1, an annular beam guidance system 2, a ring anode 4 arranged axially offset relative to the beam guidance system 2 and surrounding the patient 3 to be examined, and individually driveable electron-optical components (not shown). These electron-optical components that couple the electrons circulating on a circular specified (intended) path 5 out of that path, deflect them in the axial direction, and focus them on the ring anode 4. The ring anode 4 may, for example, be composed of tungsten/rhenium. The x-rays 7 emitted by the ring anode 4 pass through a diaphragm system acting as a collimator, and emerge as fan-shaped bundle (beam) from the beam guidance system 2, the electron-optical components and the housing accepting the ring anode 4, and ultimately penetrate into the body of the patient 3. A detector system (not shown), which is preferably likewise annularly fashioned, measures the intensity of the x-rays after attenuation by the transirradiated tissue segment. The storage and further-processing of the measured data is undertaken by a computer (not shown) in a known manner that also drives the electron-optical components of the x-ray generator. Among other things, the computer determines the point in time for activating the x-ray generation, the duration thereof and, by means of the position of the electron focus on the ring anode 4, determines the position of the x-ray source relative to the patient 3.

b) The Magnetic Guide Dipole

If one wishes to deflect the electrons onto a circular path in a purely magnetic field, it is important to consider that every guidance field generated, for example, by air coils or magnetic lenses, always exhibits inhomogeneities, the electrons do not all enter into the beam guidance system 2 with the same energy, at the same location and at the same angle, and space charge forces influence the energy distribution of the electrons. Since all of these effects cause a deflection of the electrons from the specified path 5, the beam guidance system 2 must compensate smaller deviations of the electron parameters of energy, entry location and entry angle from the values defining the specified path 5.

Figures 2A, 2B, 2C:
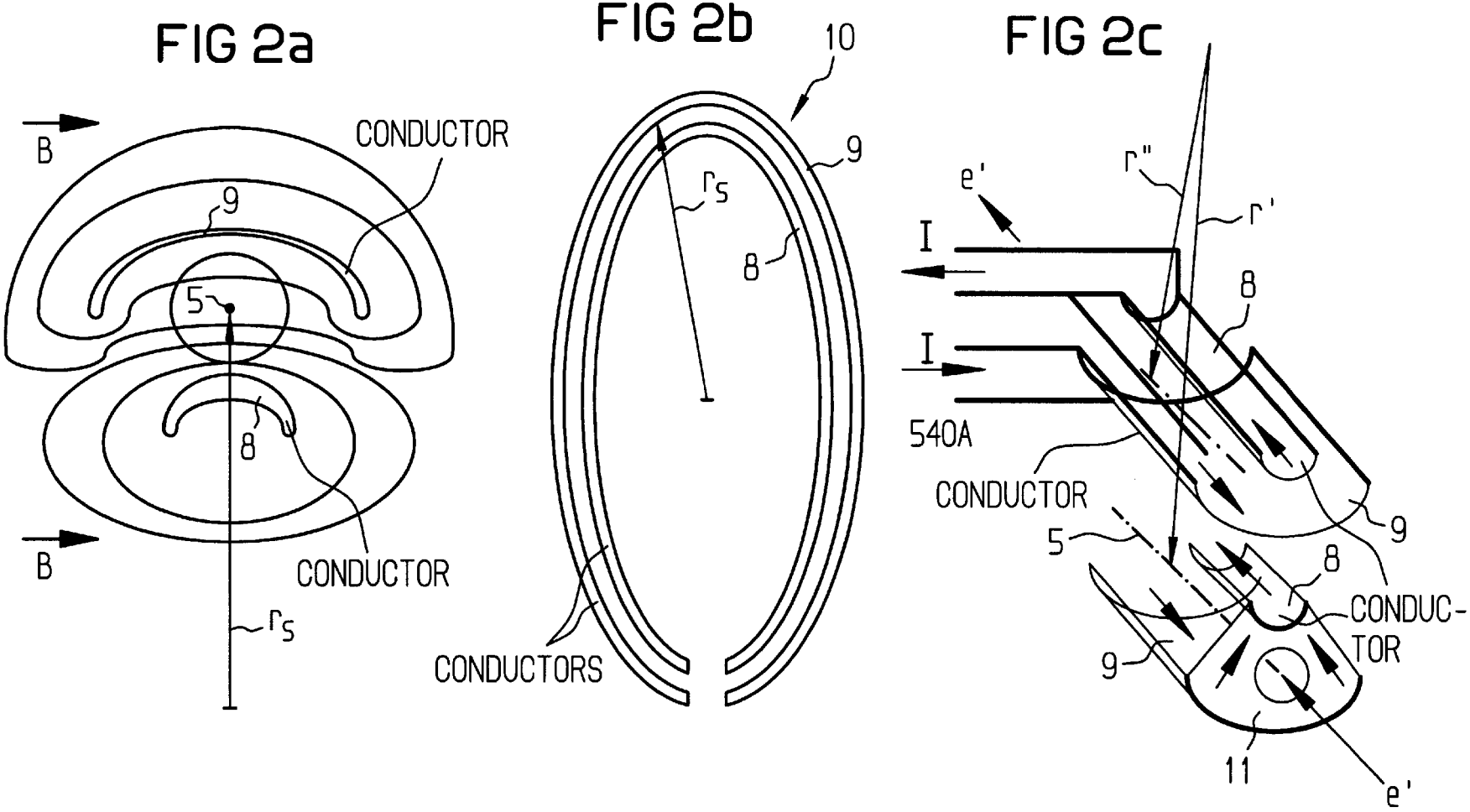
FIG. 2*a* shows a cross section of an air coil suitable for use in the inventive x-ray generator for producing a magnetic dipole field guiding the electrons along a stable circular path.
FIG. 2*b* is a schematic illustration of the arrangement of the air coil conductors.
FIG. 2*c* is a schematic illustration of portions of the air coil conductors.

The beam guidance system 2 of the x-ray generator therefore contains an air coil 10 schematically shown in FIG. 2*b,* composed of two coaxially arranged current conductors 8 and 9 that generates a magnetic dipole field having a gradient and having the radial component $B(r)=B_0\cdot(1/r^n)$ ($B_0$ is the magnetic field in the region of the specified path 5 having the radius $r_s$; r: is the path radius; n is the field index with $n=-r/B\cdot\delta B/\delta r$). When the value of the field index lies at $n=-0.5$, the radial and vertical forces driving the electrons back in the direction of the specified path 5 are of equal size. The betatron frequency then amounts to 0.7 per revolution, corresponding to an oscillation length of the electrons around the circular rated path 5 of 1.4 revolutions ("weak focusing").

FIG. 2*a* shows the two current conductors 8 and 9 of the air coil 10 in cross-section. The conductors 8 and 9 are respectively composed of a number of copper wires that are embedded in an insulator and are combined to form a bundle having the cross-sectional area in the outermost regions designated with reference numerals in FIG. 2*a*. When current flows through the conductor pair 8 and 9 a magnetic dipole field B is produced whose strength decreases continuously in the radial direction with increasing r.

As shown in FIG. 2*c,* the two current conductors 8 and 9 do not form a closed ring but rather a helix, such that the electrons coupled in the lower part of the beam guidance system 2 as well as the electrons coupled out after one revolution propagate in different levels (planes). The respectively different distances of the portions of the helix turns shown in FIG. 2*c* are indicated by radii r' and r". Providing the air coil 10 with current ensues via a terminal contacting the outer conductor 9. The current I flows in the outer conductor 9 to the input of the beam guidance system 2, proceeds via a metallic apertured diaphragm 11 into the inner conductor 8, and flows therein back to the output of the beam guidance system 2 where it flows out at a contact.

c) The Toroidal Solenoid Coil

As mentioned above, the electrons in the magnetic dipole field built up by the current conductors 8 and 9 execute betatron oscillations around the specified path 5. The amplitude of this oscillation cannot be allowed to become so high that the electrons impinge elements of the beam guidance system 2 or parts of the housing during their single revolution, and are thus lost. In the inventive x-ray generator, this is prevented by a continuous toroidal solenoid coil 12 (see FIGS. 3–5) whose magnetic field helically guides all electrons that would otherwise leave the specified path 5, due to an energy, location or angular deviation, around the specified path 5. The coupling of orthogonal phase space which is achieved as a result thereof produces an exchange of energy between the radial and vertical oscillations around the specified path 5 executed by the electrons, and thus results in damping of the respective oscillation amplitudes ("Landau damping"). The solenoid coil 12 develops a focusing effect in the region of the entry of the beam guidance 2 since the electrons follow the compressed flow lines in that region ("magnetic bottle").

Figure 3:
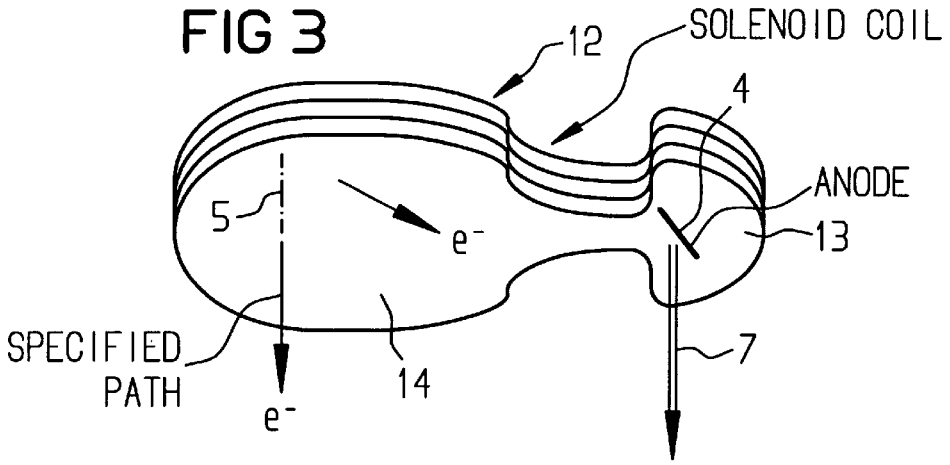
FIG. 3 shows a toroidal solenoid coil used in inventive x-ray generator, in cross-section.
Figure 4:
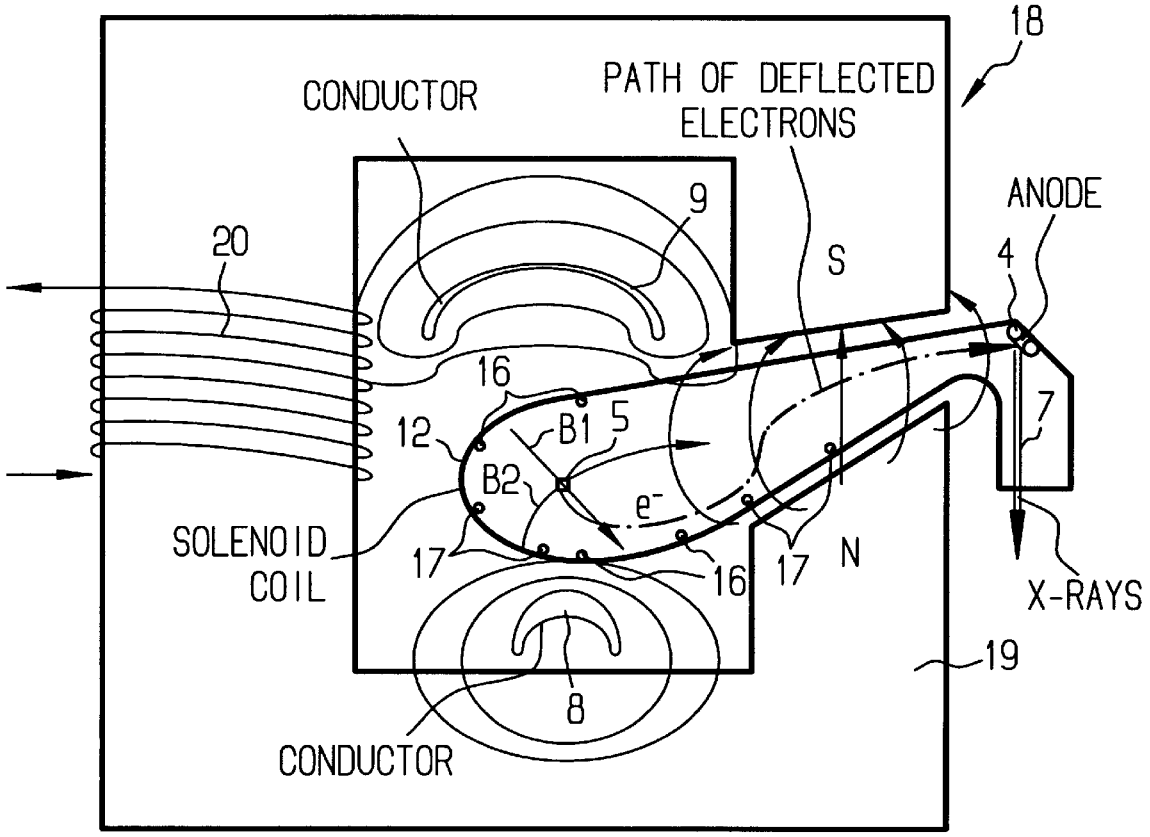
FIG. 4 is a sectional view through the upper part of an x-ray generator constructed in accordance with the principles of the present invention.
Figure 5:
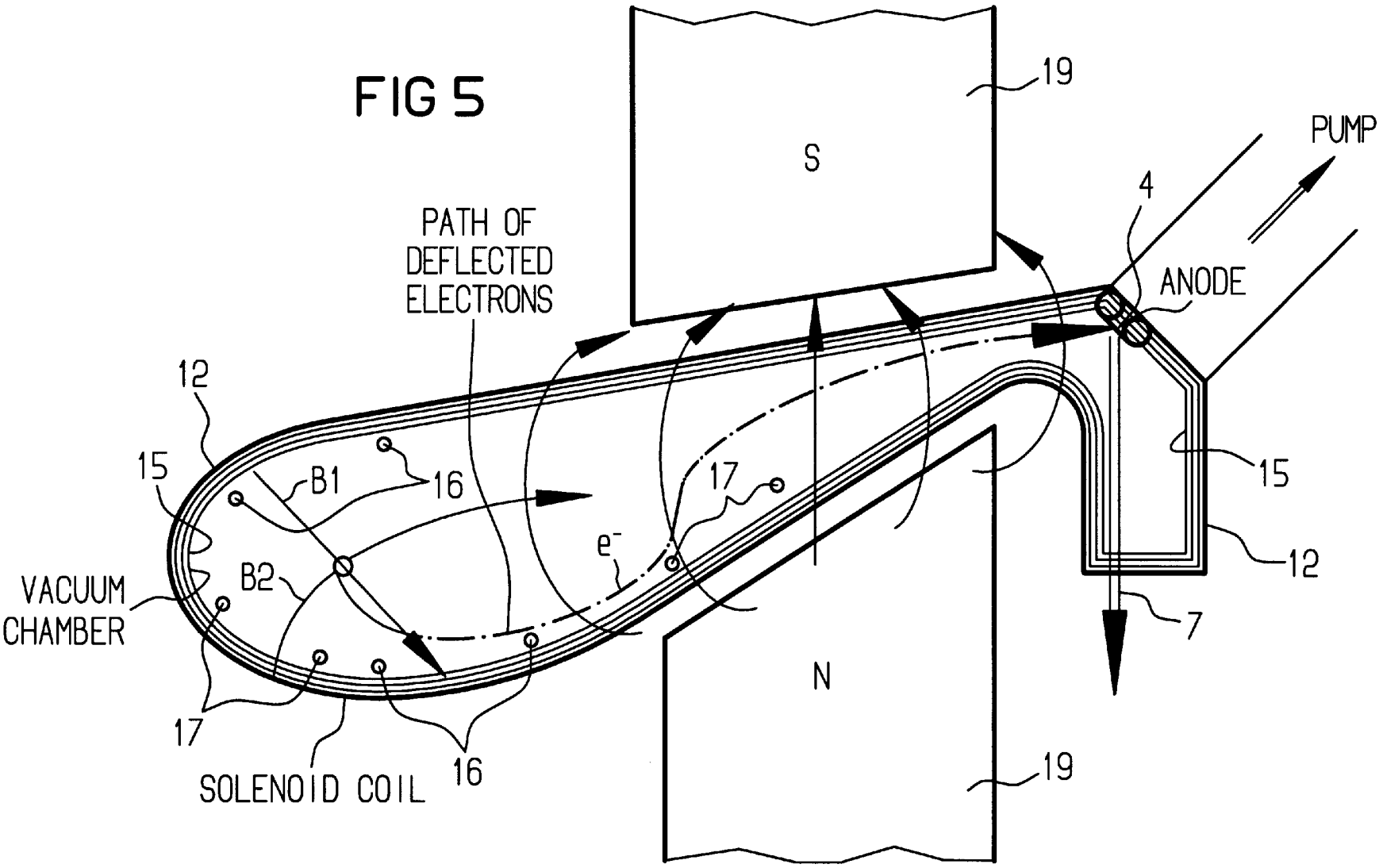
FIG. 5 shows an enlarged and more detailed sectional view of a portion of the structure shown in FIG. 4.

As FIGS. 3–5 show, the solenoid coil 12 has a non-circular cross-section with a constriction. Whereas the anode 4 is arranged in the annular, outer region 13 of the solenoid coil 12, the electrons circulate in the inner region 14 of the solenoid coil 12 that is larger in terms of volume and lies between the current conductors 8 and 9. The position of the specified path 5 within the solenoid coil 12 can be prescribed and corrected by adjusting the strength of the current flowing in the conductors 8 and 9 of the air coil 10.

In order to largely suppress eddy currents in the walls of the vacuum chamber 15 carrying the insulated aluminum windings of the solenoid coil 12, the chamber 15 is constructed thin-walled and is fabricated, for example, of a totally conducting, non-magnetic stainless steel. Stiffening ribs applied to the outside of the chamber 15 assure the mechanical stability thereof (chamber pressure $p=10^{-4}$–$10^{-7}$ Pa). An annular shoulder of the vacuum chamber 15 accepts the anode 4 mounted at an angle relative to the entering electrons, so that the generated x-rays 7 emerge primarily in the direction of the arrow. In the region of the emerging x-rays 7, the vacuum chamber 15 should be at most as weakly absorbent as, for instance, a 0.5 mm thick copper layer. The pumps are advantageously flanged to the annular part of the vacuum chamber 15, since the desorption of the residual gas molecules from the chamber wall is highest in the proximity of the radiation source, i.e. in the proximity of the anode 4.

d) The Deflector Elements

As a result of the selected cross-section of the solenoid coil 12, the electrons coupled into the beam guidance system 2 would not orbit on the specified path 5 equally distanced insofar as possible from the two current conductors 8 and 9, but would execute a helical movement around the magnetic center, i.e. the location of the lowest magnetic flux density. In order to prevent this motion, or respectively in order to intentionally intensify it for the extraction of the electrons, a number of partially overlapping deflector elements are attached on the inside of the vacuum chamber 15. Each of the, for example, N=6 or N=12 deflector elements is composed of two helically coiled conductor loops 16 and 17 (a right-handed coil as seen in the orbiting direction of the electrons, 90° helical turn). Each pair of conductor loops 16 and 17 generates a magnetic dipole field B1/B2 whose direction rotates overall by the angle $\phi=90°$ along the specified path 5 for a distance $l\approx 2\cdot\pi r_s\cdot N^{-1}$. Due to the overlapping arrangement and a corresponding alignment of neighboring pairs of conductor loops 16 and 17, it is thus possible to build up a continuously rotating dipole field in the inner region 14 of the vacuum chamber 15. When the geometrical rotation of the conductor loops 16 and 17 coincides with the magnetic rotation of the phase space ellipses produced by the solenoid coil 12 (this is always possible with an appropriate matching of the current flowing in the solenoid coil 12), the electrons can also be guided in stable fashion on the specified path 5 lying outside the magnetic center of the solenoid coil 12.

i) The Out-Coupling Dipole Magnet

For the deflection of the electrons onto the $2\pi/N$ segment of the ring anode 4 allocated to a conductor loop pair 16 and 17, the direction of the current in the appertaining conductor pair 16 and 17 is inverted for a time span of approximately $10^{-4}$ seconds, so that the briefly acting magnetic "kicker" dipole field B1/B2 drives the electrons in the direction of the middle of the vacuum chamber 15. Here, the electrons proceed into the deflection field of one of the total of N out-coupling dipole magnets 18, each of which is composed of a laminated iron yoke 19 and of a current-permeated coil 20 (See FIG. 4). Due to the outwardly tapering cross-section of the solenoid coil 12, the magnetic flux density also steadily increases in the direction of the ring anode 4. The "magnetic funnel" thus created has a focusing effect on the deflected electrons, since the windings of the solenoid coil 12 in this region are oriented approximately perpendicularly relative to the velocity vector of the electrons ("tangential" winding).

Figure 6:
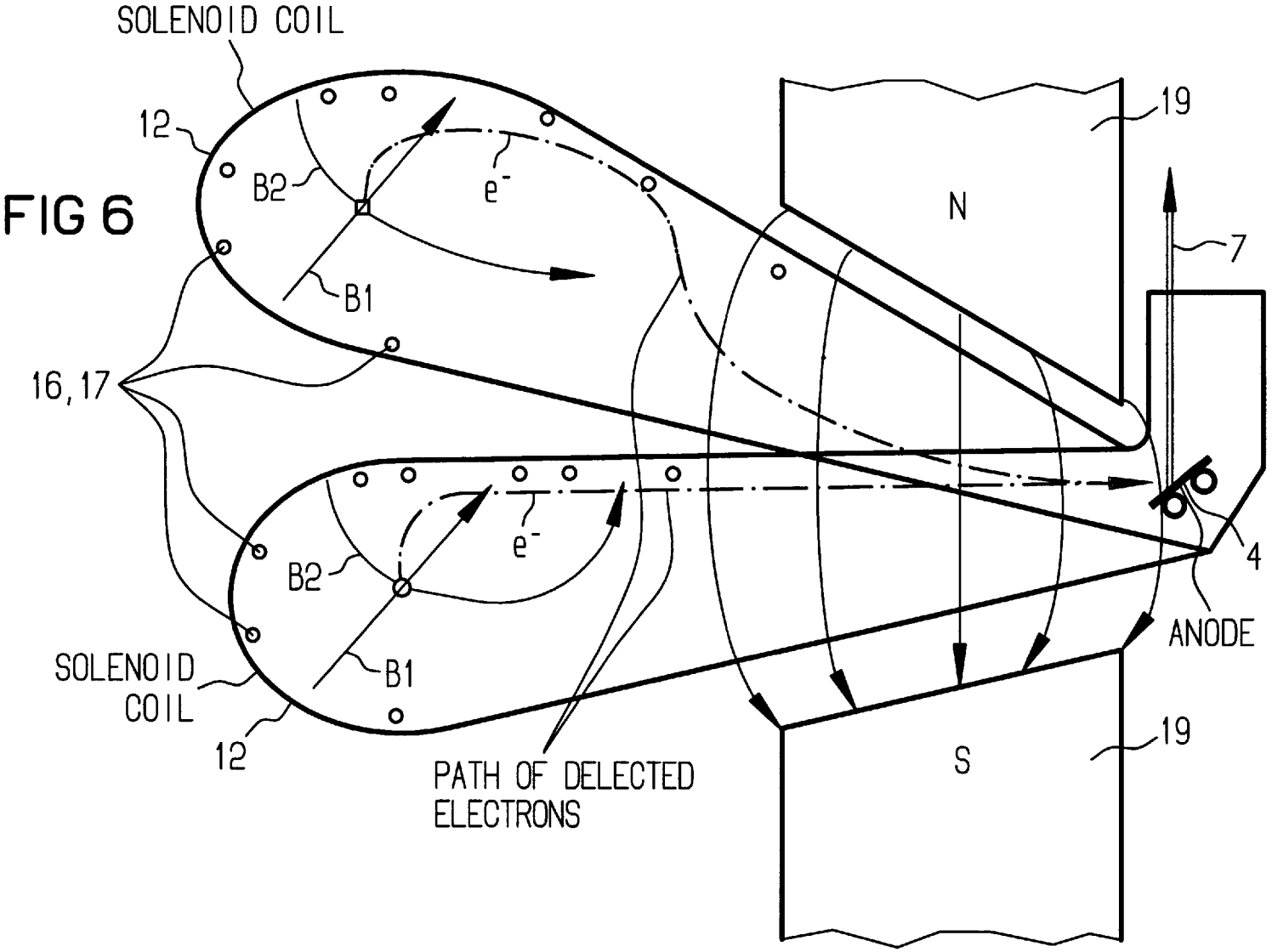
FIG. 6 shows the structure of the vacuum chamber in the region of the entering and exiting electron beam in the inventive x-ray generator.

As mentioned above, the electrons entering into and emerging from the beam guidance system 2 propagate in different levels or planes. FIG. 6 shows the position and the arrangement of the magnetic field-generating components in this region of the beam guidance system 2.

f) Technical Data

| | | |
|---|---|---|
| Electron Beam: | Energy | 150 keV ($\beta = v/c = 0.63$) |
| | Current Intensity | 1 A |
| | Diameter | 3.6 mm |
| | cw power | 150 kW |
| Guide Dipole: | Path radius | 0.65 m |
| | Magnetic field | $2.15 \cdot 10^{-3}$ T |
| | Gradient | $n = 0.5$ ($n = -r/B \cdot \bar{o}B/\bar{o}r$) |
| | Betatron frequency | 0.7 per revolution |
| | Radius of inner current conductors | 0.55 m |
| | Radius of outer current conductors | 0.75 m |
| | Intensity of current | 540 A |
| Toroidal solenoid coil: | Aperture (⊖) | 0.04 m |
| | Length | 4.0 m |
| | Intensity of current | 10 A |
| | Turns | 40,000 |
| | Magnetic field | 100 mT |
| | Power | 11 kW |
| | Current density | 10 A/mm$^2$ |
| Magnetic Dipole Loops: | Aperture (⊖) | 0.04 m |
| | Length | 0.3 m |
| | Rotation | 90° |
| | Intensity of current | ±50 A |
| | Turns | 2 (parallel) |
| | Magnetic field | ±2 mT |
| | Time constant | $T < 10^{-4}$ S |
| Out-coupling dipole magnet: | Path radius | 0.014 m |
| | Magnetic field | $100 \cdot 10^{-3}$ T |

The above-described vacuum chamber 15 preferably is composed of poorly conductive, non-magnetic stainless steel. Of course, it is also possible to fabricate this chamber 15 of a ceramic material, particularly an $Al_2O_3$ ceramic. Only elements having a low atomic number should be employed as initial materials in order to keep the absorption of the x-rays 7 generated in the vacuum chamber 15 as low as possible.

Figure 7:
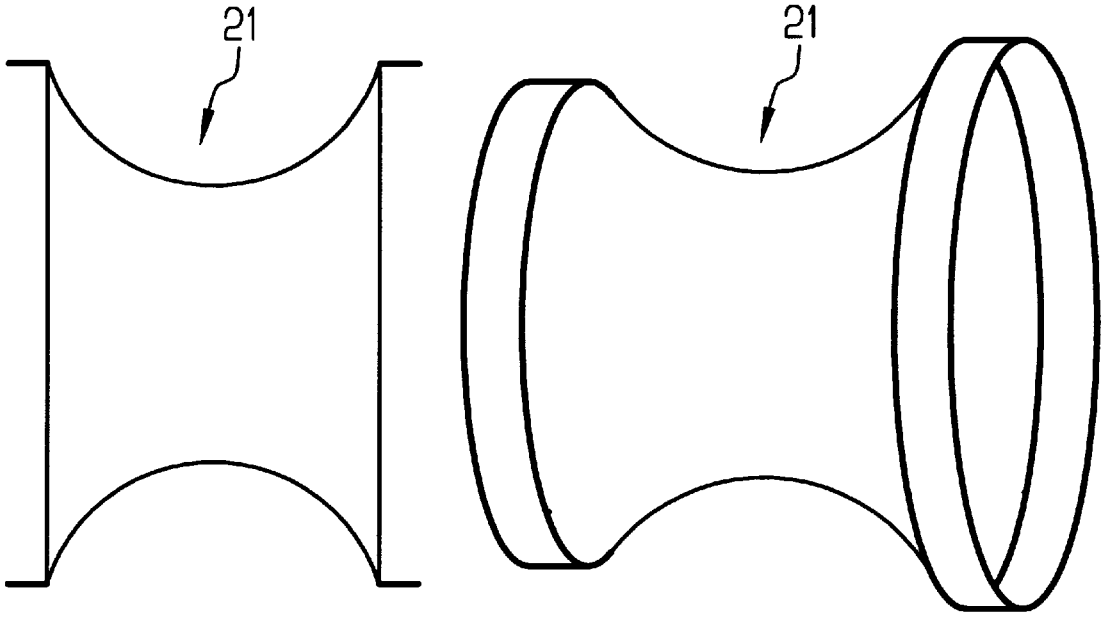
FIG. 7 shows inner part of a vacuum chamber fabricated of ceramic used in the inventive x-ray generator.
Figure 8:
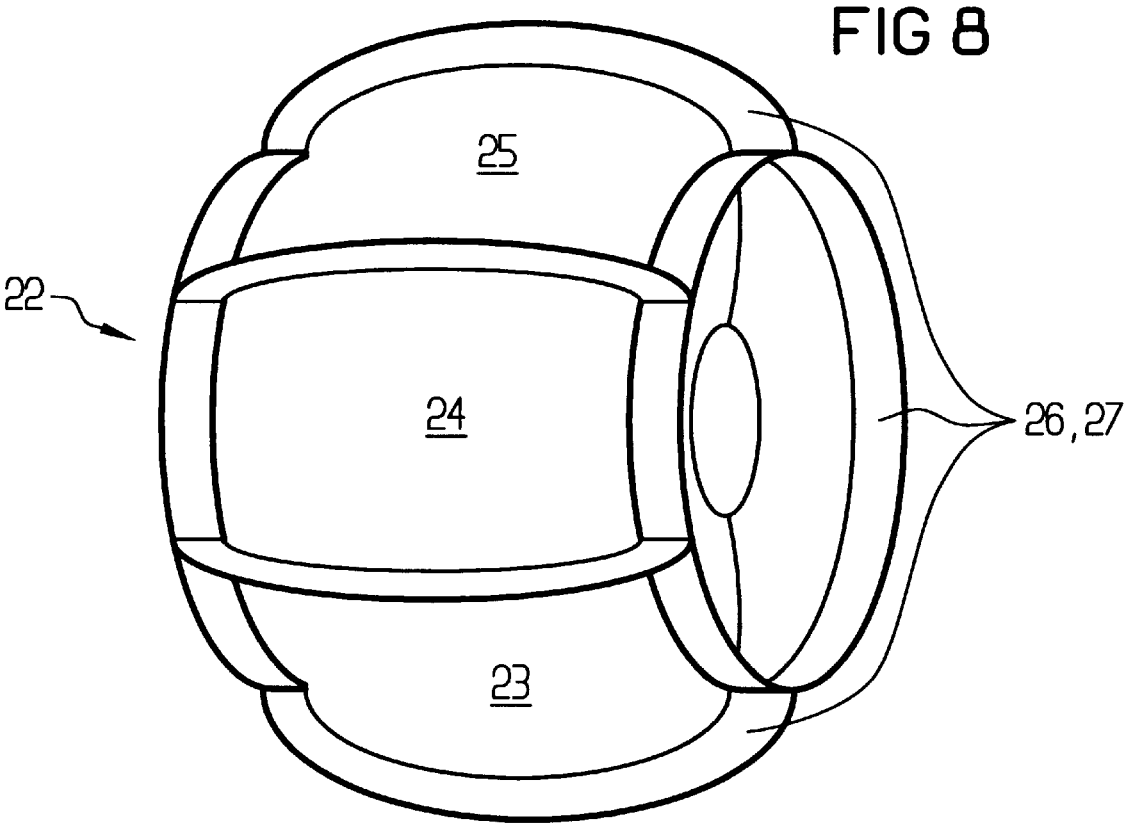
FIG. 8 shows the entire vacuum chamber in a perspective view.

As FIGS. 7 and 8 show, the corresponding chamber is preferably composed of a toroidal, inner part 21 (wall thickness d=5–8 mm) and an outer part 22 constructed in segments, whereby a total of six segments 23–25 are secured to the inner part 21 non-magnetic metal flanges 26. The mounted parts 21 and 22 form a torus that is mechanically stable with respect to the external pressure of one atmosphere, and that can be opened and serviced section-by-section by removing one of the segments 23–25.

Despite the high-frequency magnetic fields (10 kHz) generated in the chamber by the dipole loops 16 and 17 operated pulsed, no eddy currents arise since a non-magnetic insulator forms the chamber wall. The mirror current arising upon injection of the electron beam into the beam guidance system 2 can flow in the circumferential metallic flange 27. If charges of the chamber having a defocusing effect are nonetheless observed, approximately 0.1 $\mu$m thick, conductive longitudinal loops can be placed at the inside of the vacuum chamber provide alleviation.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray generator comprising:

an electron source which emits electrons;

means for circulating said electrons in a generally circular path substantially contained in a plane;

an annular anode disposed spaced from said plane;

means for deflecting said electrons from said path toward said anode;

a beam guidance system having a solenoid coil which generates a magnetic field for guiding said electrons deflected from said path onto said anode, said solenoid coil encompassing an interior volume;

said means for circulating said electrons comprising means for generating a magnetic dipole field, including an air coil having two coaxial conductor elements, defining a radius of said path superimposed on said magnetic field of said solenoid coil; and said anode being disposed in said interior volume.

2. An x-ray generator as claimed in claim 1 wherein said solenoid coil has a cross-section having a constriction tapering in a direction toward said anode, said constriction dividing said solenoid coil into an outer region and an inner region, said anode being disposed in said outer region and said path of said electrons passing through said inner region.

3. An x-ray generator as claimed in claim 2 wherein said magnetic dipole field comprises a first magnetic dipole field, and said x-ray generator further comprising means for generating a second magnetic dipole field rotating transversely relative to a propagation direction of said electrons in said path, said second magnetic dipole field being superimposed on said magnetic field of said solenoid coil in said inner region.

4. An x-ray generator as claimed in claim 3 wherein said means for generating said second magnetic dipole field comprises a plurality of deflector elements disposed in said inner region.

5. An x-ray generator as claimed in claim 4 wherein said plurality of deflector elements include two helically oriented conductor pairs disposed in said inner region.

6. An x-ray generator as claimed in claim 3 further comprising means for generating a third magnetic dipole field superimposed on said magnetic field of said solenoid coil in said constriction.

7. An x-ray generator as claimed in claim 6 wherein said means for generating said third magnetic dipole field comprises a laminated iron yoke having legs respectively disposed on opposite sides of said constriction, and said yoke having an electrical winding thereon.

8. An x-ray generator as claimed in claim 1 further comprising a toroidal vacuum chamber containing said anode.

9. An x-ray generator as claimed in claim 8 wherein said vacuum chamber comprises a toroidal inner part, and an outer part comprising a plurality of joined segments, said segments being connected to said inner part by flanges.

10. An x-ray generator as claimed in claim 9 wherein said vacuum chamber and said flanges are composed of a non-magnetic material.

11. An x-ray generator as claimed in claim 9 wherein said vacuum chamber is composed of a stainless steel.

12. An x-ray generator as claimed in claim 9 wherein said vacuum chamber is composed of a ceramic material.

* * * * *